US008056751B2

(12) United States Patent
Vovan

(10) Patent No.: US 8,056,751 B2
(45) Date of Patent: Nov. 15, 2011

(54) FAST CLOSING-TWIST TOP OPENING PACKAGING SYSTEM

(75) Inventor: Terry Vovan, Upland, CA (US)

(73) Assignee: PWP industries (California Corporation), Vernon, CA (US)

( * ) Notice: Subject to any disclaimer, the term of this patent is extended or adjusted under 35 U.S.C. 154(b) by 973 days.

(21) Appl. No.: 11/998,582

(22) Filed: Nov. 30, 2007

(65) Prior Publication Data

US 2008/0105681 A1 May 8, 2008

Related U.S. Application Data

(63) Continuation-in-part of application No. 10/645,893, filed on Aug. 18, 2003.

(51) Int. Cl.
*B65D 41/06* (2006.01)
*B65D 21/036* (2006.01)

(52) U.S. Cl. ..... 220/300; 206/508; 220/297; 220/298; 220/293

(58) Field of Classification Search ..... 220/297, 220/298, 293, 300; 206/508
See application file for complete search history.

(56) References Cited

U.S. PATENT DOCUMENTS

| | | | |
|---|---|---|---|
| 235,278 | A | 12/1880 | Norton |
| 235,279 | A | 12/1880 | Norton |
| 1,312,587 | A | 8/1919 | Sinn et al. |
| 1,515,560 | A | 11/1924 | Elwell |
| 1,579,942 | A | 4/1926 | Jensvold |
| 1,582,429 | A | 4/1926 | Podel |
| 1,619,423 | A | 3/1927 | Korn |
| 1,738,893 | A | 12/1929 | Grady |
| 2,071,266 | A | 2/1937 | Schmidt |
| D156,860 | S | 1/1950 | Zaikaner |
| 2,675,040 | A | 4/1954 | Raun et al. |

(Continued)

FOREIGN PATENT DOCUMENTS

| | | |
|---|---|---|
| CH | 421 805 | 4/1967 |

(Continued)

OTHER PUBLICATIONS

European Search Report in EP250665 dated Jun. 4, 2009.

(Continued)

*Primary Examiner* — Mickey Yu
*Assistant Examiner* — Niki Eloshway
(74) *Attorney, Agent, or Firm* — Baker Botts L.L.P.

(57) ABSTRACT

Base and cover elements (12, 14) of a food container (10) can be rapidly closed at a plant and can be easily opened and closed by a customer. The cover has a lower rim wall (44) with a plurality of radially inward cover projections (50) spaced about the container axis (20), and the base has a base rim wall (32) with a plurality of recesses (52) with undercut grooves (60) that each receives a cover projection to hold the cover closed on the base. The bottom surface (86) of the cover projections and the top surface (80) of the base rim wall are beveled, so the cover can be installed by forcefully pushing it down, at any rotational position of the cover on the base. The cover then can be easily removed by turning it, with the cover projections moving along undercut base grooves (60), until the cover projections reach vertical passages (54) through which the projections can be easily lifted. The base has a handle (90) to prevent the base from turning, comprising a sheet-like tab that projects radially outward under the cover and that forms upstanding shoulders (94, 96).

12 Claims, 17 Drawing Sheets

U.S. PATENT DOCUMENTS 2,816,682 A 12/1957 Brucker
3,070,251 A 12/1962 Mangravite
3,351,751 A 11/1967 Stube et al.
3,371,817 A 3/1968 Gasbarra et al.
D214,391 S 6/1969 Weiss
3,680,745 A 8/1972 Landen
3,690,902 A 9/1972 Dahl
3,833,147 A 9/1974 Borsum et al.
3,844,443 A 10/1974 Cudzik
3,854,582 A 12/1974 Martinelli
3,931,891 A 1/1976 Peppler
4,119,232 A 10/1978 Thornton
4,126,224 A 11/1978 Laauwe et al.
4,128,184 A 12/1978 Northup
4,135,331 A 1/1979 Lamlee
4,158,983 A 6/1979 Amico
4,197,940 A 4/1980 DeRossett
4,279,355 A 7/1981 Schwartz et al.
4,305,180 A 12/1981 Schwartz
4,333,580 A 6/1982 Sweigart, Jr.
4,375,862 A 3/1983 Kurinsky et al.
4,398,688 A 8/1983 Williams
4,434,903 A 3/1984 Cooke
4,473,170 A 9/1984 Ciancimino
4,516,678 A 5/1985 Fotiadis et al.
4,671,263 A 6/1987 Draenert
4,705,163 A 11/1987 James
4,863,058 A 9/1989 Antoni et al.
4,867,303 A 9/1989 Beckerman et al.
4,874,083 A 10/1989 Antoni et al.
4,896,783 A 1/1990 Leoncavallo et al.
4,991,811 A 2/1991 Portnoy
5,027,973 A 7/1991 Drogos
5,072,850 A 12/1991 Gagnon et al.
5,154,295 A 10/1992 Stoner
5,207,345 A 5/1993 Stewart et al.
5,232,112 A 8/1993 Howard
5,273,174 A 12/1993 Fisher
5,287,959 A * 2/1994 Hansen et al. ..... 220/787
5,320,233 A 6/1994 Welch
D352,000 S 11/1994 Hansen et al.
5,409,128 A 4/1995 Mitchell
5,445,269 A 8/1995 Williams
5,456,379 A 10/1995 Krupa et al.
5,529,202 A 6/1996 Shamis
D371,964 S 7/1996 Krupa
5,542,206 A 8/1996 Lisch
5,605,244 A * 2/1997 Bradshaw ..... 220/320
5,613,607 A 3/1997 Kalmanides et al.
5,638,976 A 6/1997 Arnold
5,662,233 A 9/1997 Reid
5,671,856 A 9/1997 Lisch
5,711,442 A 1/1998 Kusz
5,810,209 A 9/1998 Foster
5,931,333 A 8/1999 Woodnorth et al.
5,947,318 A 9/1999 Palm
5,975,322 A 11/1999 Reid
6,209,725 B1 4/2001 Chen
6,234,338 B1 5/2001 Searle
6,257,401 B1 7/2001 Mangla et al.
6,302,268 B1 10/2001 Michaeli
6,349,847 B1 2/2002 Mangla et al.
6,595,366 B1 7/2003 Brown
6,662,950 B1 12/2003 Cleaver
6,688,487 B2 * 2/2004 Oakes et al. ..... 220/788
D494,468 S 8/2004 Vovan
6,874,650 B2 4/2005 Welsh et al.
6,880,697 B2 * 4/2005 Cheng ..... 206/303
6,971,521 B2 12/2005 Pinyot
D524,646 S 7/2006 Hellenbrand et al.
7,198,169 B2 4/2007 Silk
7,337,914 B2 3/2008 Spindel et al.
7,337,917 B2 3/2008 Kortleven
2002/0017525 A1 2/2002 Searle et al.
2002/0053569 A1 5/2002 Mills et al.
2004/0099548 A1 * 5/2004 Ito et al. ..... 206/303
2005/0161455 A1 7/2005 Studee
2007/0000922 A1 1/2007 Vovan et al.
2007/0051733 A1 3/2007 Franzen
2007/0235457 A1 10/2007 Merey

FOREIGN PATENT DOCUMENTS

EP 0818171 B1 1/1998

OTHER PUBLICATIONS

U.S. Appl. No. 12/154,369, filed Mar. 17, 2009 Non-Final Office Action.
U.S. Appl. No. 12/154,369, filed Jun. 5, 2009 Response to Non-Final Office Action.
U.S. Appl. No. 12/154,369, filed Oct. 19, 2009 Final Office Action.
U.S. Appl. No. 12/154,369, filed Dec. 4, 2009 Respnse to Final Office Action.
U.S. Appl. No. 12/154,369, filed Dec. 18, 2009 Amendment After Final Entered.
U.S. Appl. No. 12/154,369, filed Dec. 18, 2009 Notice of Allowance.
U.S. Appl. No. 10/645,893, filed Oct. 11, 2006 Non-Final Office Action.
U.S. Appl. No. 10/645,893, filed Jan. 16, 2007 Response to Non-Final Office Action.
U.S. Appl. No. 10/645,893, filed Mar. 5, 2007 Final Office Action.
U.S. Appl. No. 10/645,893, filed Jun. 7, 2007 Response to Final Office Action.
U.S. Appl. No. 10/645,893, filed Jun. 11, 2007 Notice of Appeal Filed.
U.S. Appl. No. 10/645,893, filed Jun. 21, 2007 Amendment After Final Entered.
U.S. Appl. No. 10/645,893, filed Jun. 21, 2007 Advisory Action.
U.S. Appl. No. 10/645,893, filed Jul. 30, 2007 Appeal Brief Filed.
U.S. Appl. No. 10/645,893, filed Aug. 29, 2007 Notice of non-compliant amendment.
U.S. Appl. No. 10/645,893, filed Mar. 7, 2008 Appeal Brief Filed.
U.S. Appl. No. 10/645,893, filed May 29, 2008 Non-Final Office Action.
U.S. Appl. No. 10/645,893, filed Aug. 29, 2008 Response to Non-Final Office Action.
U.S. Appl. No. 10/645,893, filed Dec. 15, 2008 Final Office Action.
U.S. Appl. No. 10/645,893, filed Mar. 20, 2009 Notice of Appeal Filed.
U.S. Appl. No. 10/645,893, filed Mar. 20, 2009 Appeal Brief Filed.
U.S. Appl. No. 10/645,893, filed May 3, 2009 Appeal Brief Filed.
U.S. Appl. No. 10/645,893, filed Aug. 14, 2009 Examiner's Answer to Appeal Brief.
U.S. Appl. No. 10/645,893, filed Sep. 10, 2009 Reply Brief Filed.
U.S. Appl. No. 10/645,893, filed Nov. 16, 2009 Reply Brief Noted.
U.S. Appl. No. 12/658,032, filed Aug. 26, 2010 Non-Final Office Action.
U.S. Appl. No. 12/658,032, filed Nov. 24, 2010 Response to Non-Final Office Action.
U.S. Appl. No. 12/154,369, filed May 22, 2008.
U.S. Appl. No. 12/328,686, filed Dec. 4, 2008.
U.S. Appl. No. 10/645,893, filed Aug. 18, 2003.
U.S. Appl. No. 12/658,032, filed Feb. 1, 2010.
U.S. Appl. No. 12/658,032, filed Feb. 18, 2011 Final Office Action.
U.S. Appl. No. 12/658,032, filed Apr. 18, 2011 Response to Final Office Action.
U.S. Appl. No. 12/658,032, filed Apr. 27, 2011 Notice of Allowance.
U.S. Appl. No. 12/328,868, May 27, 2011 Non-Final Office Action.

* cited by examiner

FAST CLOSING-TWIST TOP OPENING PACKAGING SYSTEM

CROSS-REFERENCE

This is a continuation-in-part of U.S. patent application Ser. No. 10/645,893 filed Aug. 18, 2003.

BACKGROUND OF THE INVENTION

A cake is commonly placed in a container that includes a base that supports a cardboard sheet on which the cake rests, and a cover that has a cover rim that extends around the base rim. A round cake is placed in a container with circular base and cover outer edges that are centered on a container axis. One type of container, described in U.S. Pat. No. 5,613,607, includes a base that forms at least two threads and a cover that forms thread parts that can be screwed into place. It can be difficult to properly engage all threads. Also, in a plant where cakes are loaded onto a base and the cover is closed on the base, a very short time such as no more than a second, is allocated for closing each cover on a base. There is a need for a container that can be closed very rapidly by brute force. However, when a customer buys the cake and container, it is desirable that the customer be able to properly close and open the container using only moderate forces.

SUMMARY OF THE INVENTION

In accordance with one embodiment of the invention, a food container is provided, especially to hold a cake, which includes a base and cover each formed of a sheet of plastic with a circular periphery, which enables the cover to be very rapidly closed on the base by brute force at a loading plant, and which thereafter enables the container to be opened and closed by a customer using only moderate force. The cover bottom has a primarily vertical cover rim wall that surrounds a base rim wall. The cover rim wall has a plurality of projections and the base rim wall has a plurality of recesses that each can receive a cover projection. The cover projections have lower surfaces that are beveled, and the base has a beveled upper surface. When the cover is pushed down forcefully the beveled surfaces ride one over the other until the cover projections lie at least partially in the base recesses to hold the cover closed.

The base recesses each includes a vertical passage and an undercut groove that extends circumferentially from a vertical passage to a stop. A customer usually opens the container by turning the cover about the axis while the cover projections each slides along a groove and into a vertical passage. The projections can be easily lifted along a vertical passage to lift the cover off the base. The customer closes the cover on the base in a reverse fashion. However, as mentioned above, the cover can be very rapidly installed at a factory, by pushing it down with brute force.

The cover and base have handles for turning the cover relative to the base. The base handle is a tab formed by a base sheet portion, that extends under the bottom of the cover rim wall and along a horizontal surface on which the base lies. The tab has a radially outer part with an upward-projection forming shoulders that can be pushed circumferentially to prevent base rotation in either direction.

The novel features of the invention are set forth with particularity in the appended claims. The invention will be best understood from the following description when read in conjunction with the accompanying drawings.

DESCRIPTION OF THE PREFERRED EMBODIMENTS

I. FIGS. 1-11

Figure 1:
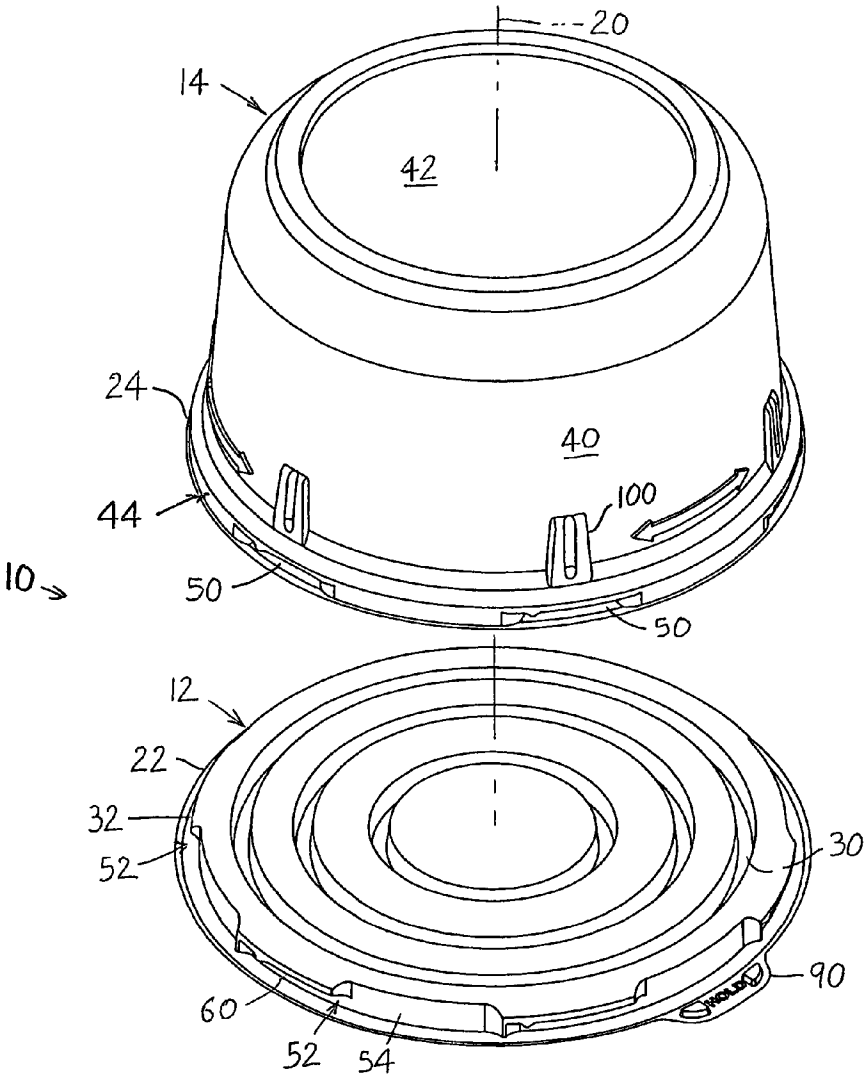
FIG. 1 is an exploded top isometric view of a container of the present invention.
Figure 2:
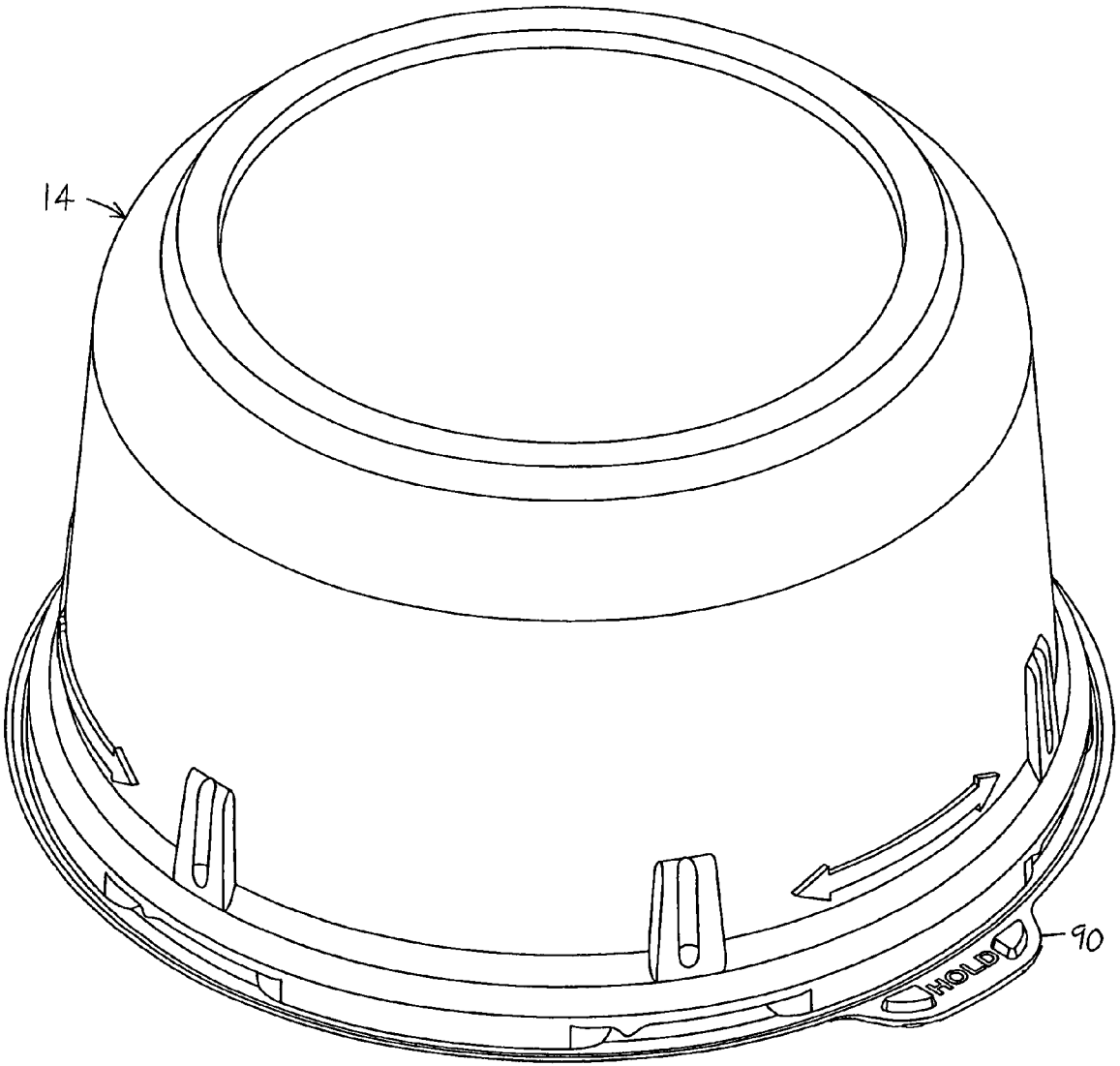
FIG. 2 is a top isometric view of the container of FIG. 1, with the cover closed on the base.

FIG. 1 shows a container 10 of the invention which includes a base 12 and a cover 14 for covering the base. The container is designed to hold food, and especially a cake. The container has a vertical axis 20 and the base and cover have generally circular radially (with respect to the axis) outer edges 22, 24 (except at handles that occupy less than 20° of space around the axis) centered on the axis. The base has a generally horizontal bottom 30 for resting on a horizontal surface and has a primarily vertical base rim wall 32. The cover has a primarily vertical side wall or side 40, and has a generally horizontal top 42. The primarily vertical side includes a primarily vertical cover rim wall 44 that lies around the base rim wall 32 when the container is closed.

The cover rim wall 44 has a plurality of radially-inward cover projections 50. The base rim wall 32 forms a plurality of radially-inward base recesses 52 which are designed to receive the cover projections to latch down the cover onto the base. The base and cover are each formed of a sheet of plastic that has been deformed (it is possible to mold the cover and base to form sheet plastic). The cover projections 50 result from radially inwardly deforming one plastic sheet and the base recesses 52 result from radially inwardly deforming another plastic sheet.

Figure 3:
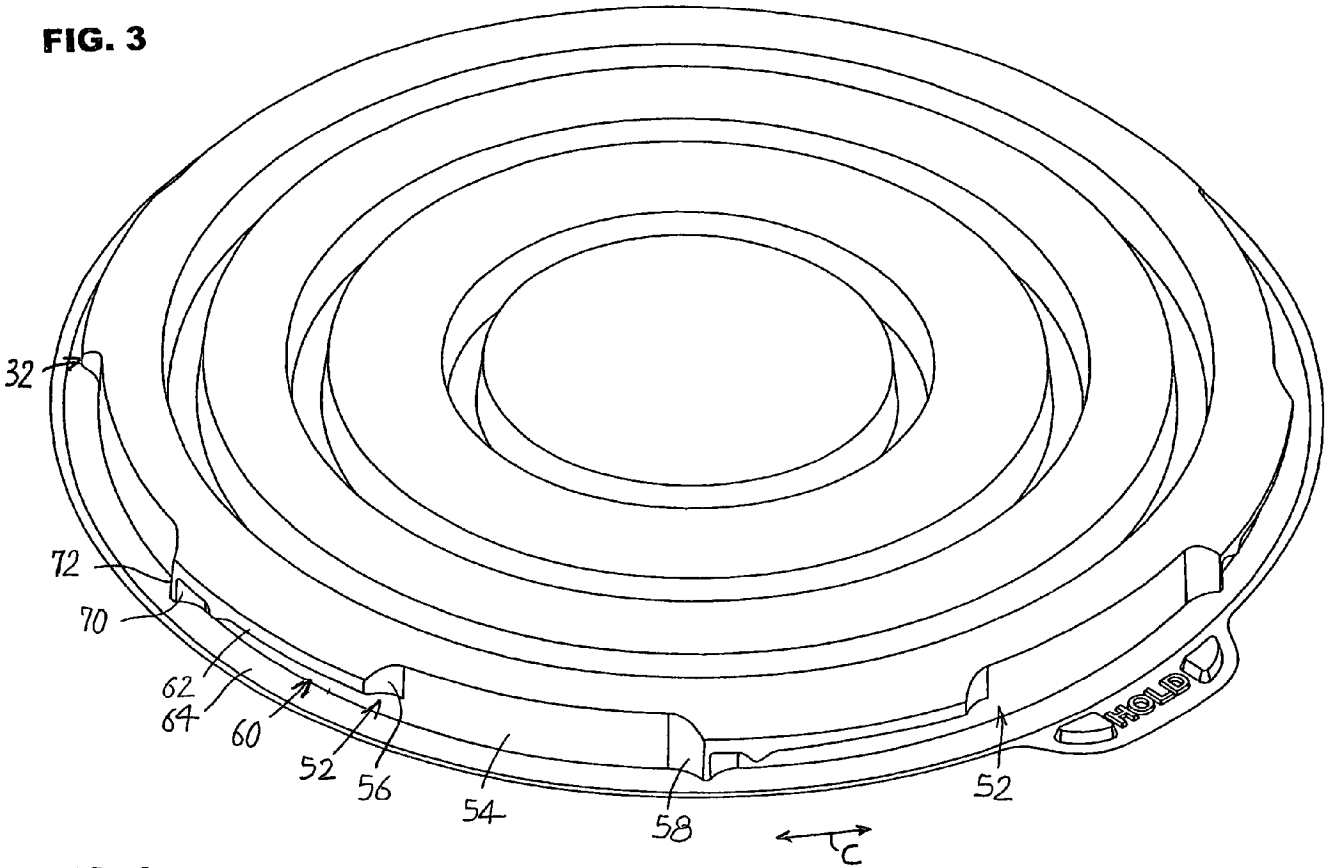
FIG. 3 is a top isometric view of the base of the container of FIG. 1.
Figure 4:
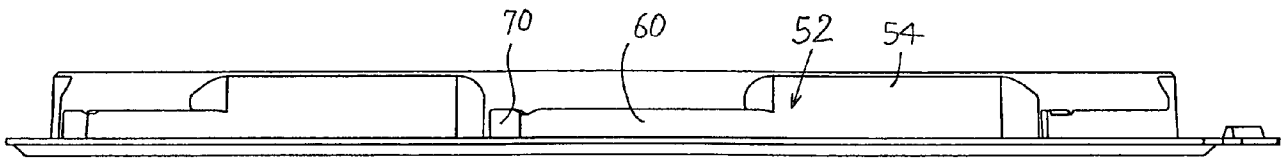
FIG. 4 is a front elevation view of the base of FIG. 3.

FIG. 3 shows that each base recess 52 includes a vertical passage 54 in the base rim wall, the vertical passage being without a barrier to upward or downward movement respectively into and out of the passage. The vertical passage is circumferentially C elongated and has far and near ends 56, 58. The recess also includes a circumferentially-elongated undercut groove 60 with top and bottom groove walls 62, 64 and that extends circumferentially from end 56 of the vertical passage. The groove has a far end 70 that forms a stop 72. The groove 60 is vertically undercut because its top groove wall 62 lies over the groove and prevents a cover projection 50 that lies in the groove from being lifted vertically out of the groove.

Figure 5:
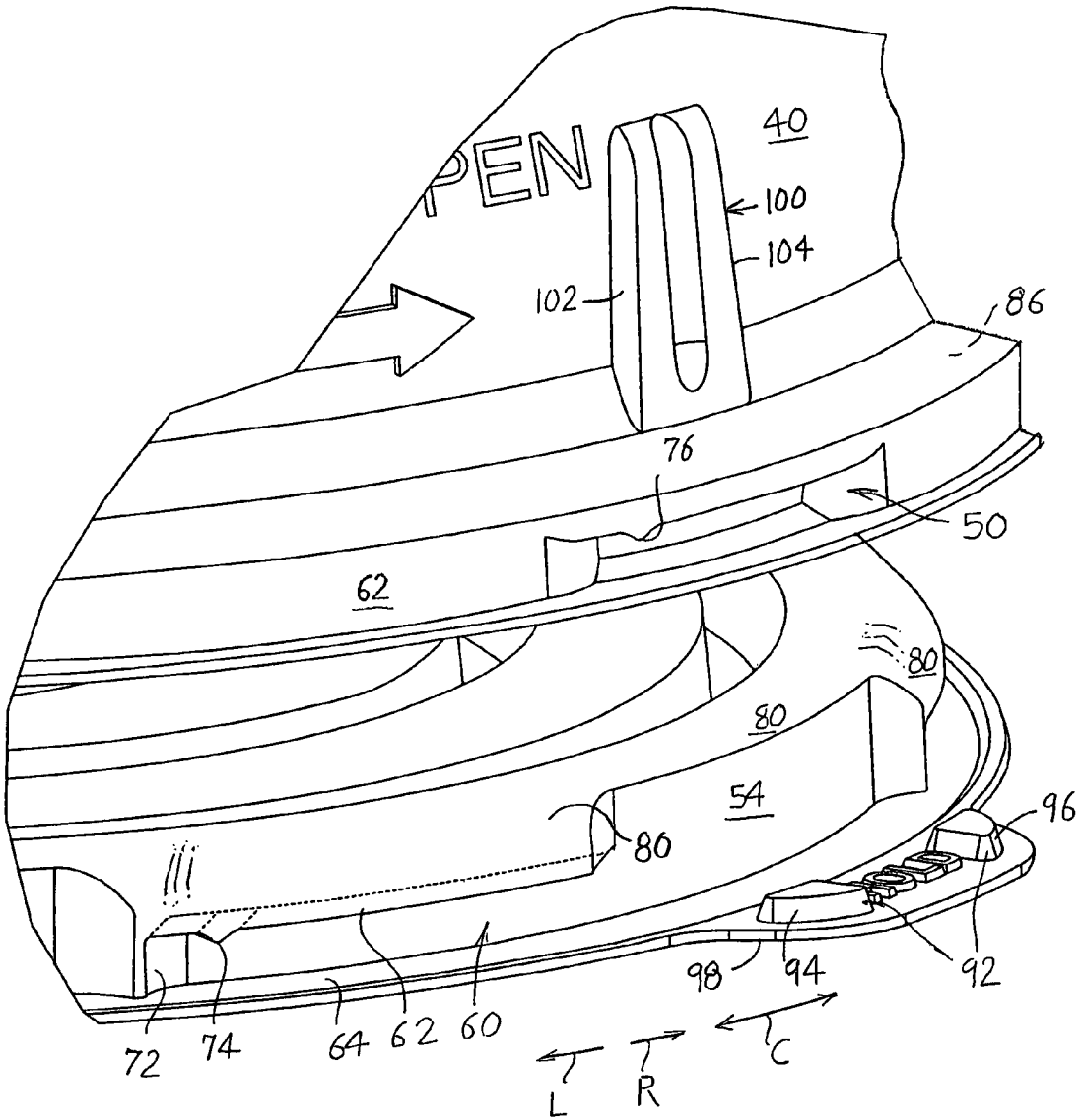
FIG. 5 is an enlarged and exploded top isometric view of a portion of the container of FIG. 1, showing how cover projections can move into base recesses.

FIG. 5 shows that each cover projection 50 has a circumferential length that is a plurality of times its vertical height. The cover projection and base vertical passage 54 have about the same circumferential length, and the cover can be lowered onto the base by aligning the cover projections with the vertical passages. Then, the lowered cover can be turned between 5° and 30° in direction L so each cover projection moves along a groove 60 until it abuts a stop 72. A vertical jut 74 on a groove wall has a slight interference with a vertical jut 76 on the cover projection, and the customer may have to apply extra torque to move the juts past one another. The juts prevent loosening of the cover. Much of the time spent by a customer in closing the container is in aligning the cover projections 50 with the vertical passages 54 in the base. It may take perhaps ten seconds for a customer to open or close the container in this way. This period is too long to be acceptable in a factory or other loading station where a cake lying on a cardboard plate is loaded onto the base and placed onto a conveyer belt. A person who places a cover on the base and closes it is expected to close covers at a rate of perhaps 80 per minute or about one per second.

Figure 8:
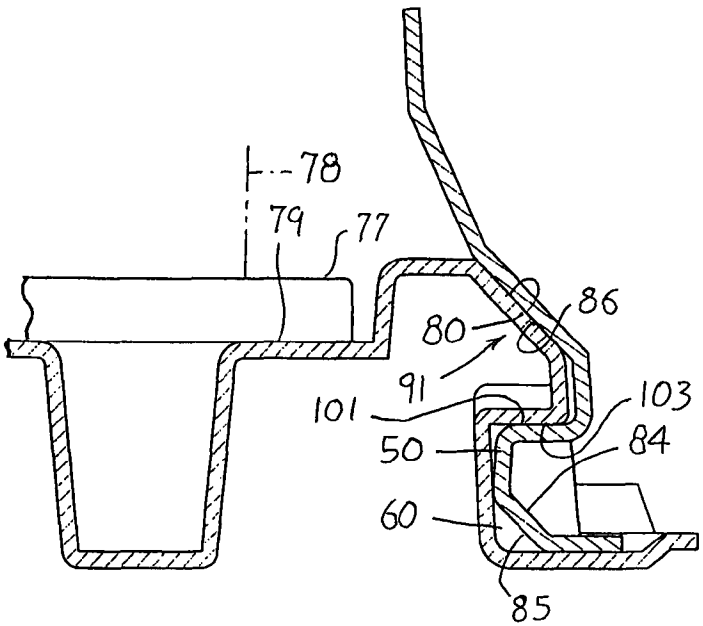
FIG. 8 is a sectional view similar to that of FIG. 7, but with the cover fully closed on the base.
Figure 7:
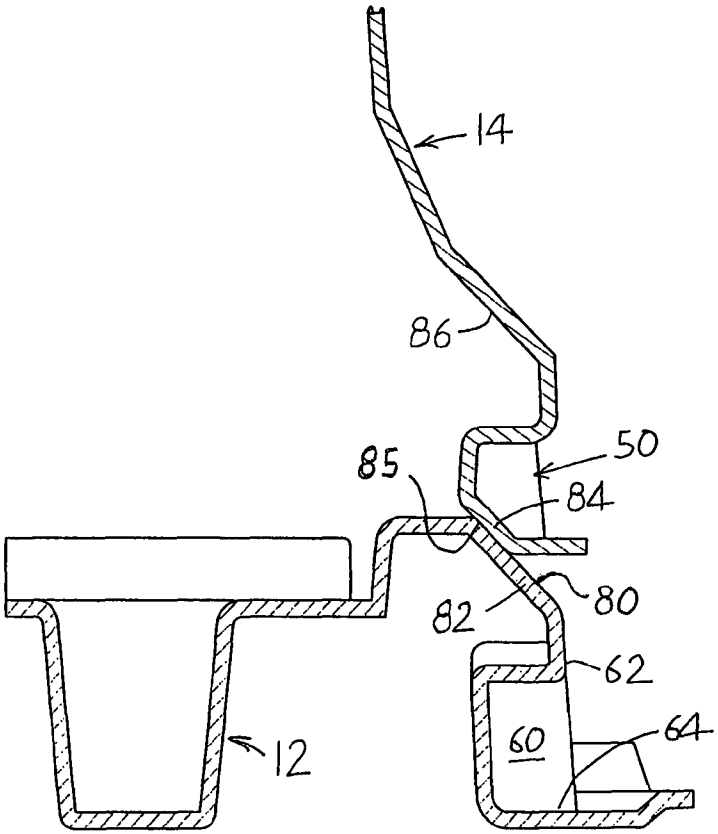
FIG. 7 is a sectional view taken on line A-A of FIG. 6 showing the container in the process of closing, but with the cover rim wall not yet pushed down onto the base rim wall.

In accordance with the present invention, the cover and base are constructed so the cover can be closed on the base very rapidly, such as in one second or less. Such closing occurs after a cardboard plate 77 (FIG. 8) with a cake 78 thereon is placed on a base support surface 79. Such closing is accomplished by forcefully pushing down the cover on the base. As shown in FIGS. 7 and 8, the base has a beveled surface 80 formed by beveled surface portions, on a top part 82 that is part of or immediately above the groove top wall 62, with the bevel also lying above the stop 72. The cover projection 50 has a lower wall 84 with a beveled lower surface 85. FIGS. 7 and 8 show that when the cover 14 is pushed down forcefully to the fully down position of FIG. 8, the beveled surfaces 80, 85 deflect the plastic of the base and cover to allow the cover projections to pass down across the groove top wall 62 and other parts to the fully down position of FIG. 8, and to latch to the base as in FIG. 8. In FIG. 8 an upward-facing shoulder 101 of the cover projection 50 engages a downward-facing shoulder 103 of the base. The beveled surfaces 80, 85, which extend at downward and radially outward inclines from the horizontal, preferably extend at inclines of at least 30° to the horizontal, the particular surfaces shown extending at 45° to the horizontal. The cover has another beveled surface or surface portions 86 that come to rest against the base beveled surface 80 when the cover is closed (FIG. 8). These surfaces 80, 86 extend parallel to each other and form a seal 91 to keep the cake fresh. It is possible for at least one of sealing surfaces 80, 86 to be curved instead of both being straight at their contacting locations.

Each cover projection may lie at a variety of circumferential positions with respect to the base when a worker forcefully pushes down the cover onto the base. In rare instances the cover projections are perfectly aligned with the base vertical passages, and then the holding of the cover depends on any slight interference fit (radially or circumferentially) of the projections with the walls of the vertical passage, or applicant can rely on the weight of the cover to hold it down or rely on a clerk to turn it if there is rattling. In most instances, one end portion of each cover projection lies in a vertical passage 54 and the other end has to pass down across a groove top wall 62. A forceful downward movement of the cover by a worker accomplishes this and latches down the cover. In some instances, each cover projection 50 presses against a stop 72 (FIG. 5), in which case the radial interference fit between them holds down the cover.

Thus, the container allows rapid cover installation by a worker at a plant, with an interference fit to hold down the cover in almost all instances. However, the container also allows a customer with more time to "properly" open and close the cover by rotating the cover.

To facilitate rotation of the cover by about 20 degrees, applicant provides at least one handle on the base and on the cover. The cover rim wall 44 (FIG. 1) lies around the base rim wall 32, so it can be difficult to obtain access to the base to prevent its rotation (or to rotate it), especially to move the juts 74, 76 past each other. The handle 90 on the base is formed by a piece of the plastic sheet that forms a tab that lies in a horizontal plane and projects radially outward to extend under the outer edge 24 of the cover and at least one centimeter beyond the cover outer edge. As shown in FIG. 5, the tab has an upstanding portion(s) 92 that forms shoulders 94, 96 facing in circumferentially opposite directions L, R so the base can be held against turning when the cover turns. The planar bottom 98 of the tab lies within 5 millimeters of a horizontal surface that the bottom of the base lies on.

Figure 6:
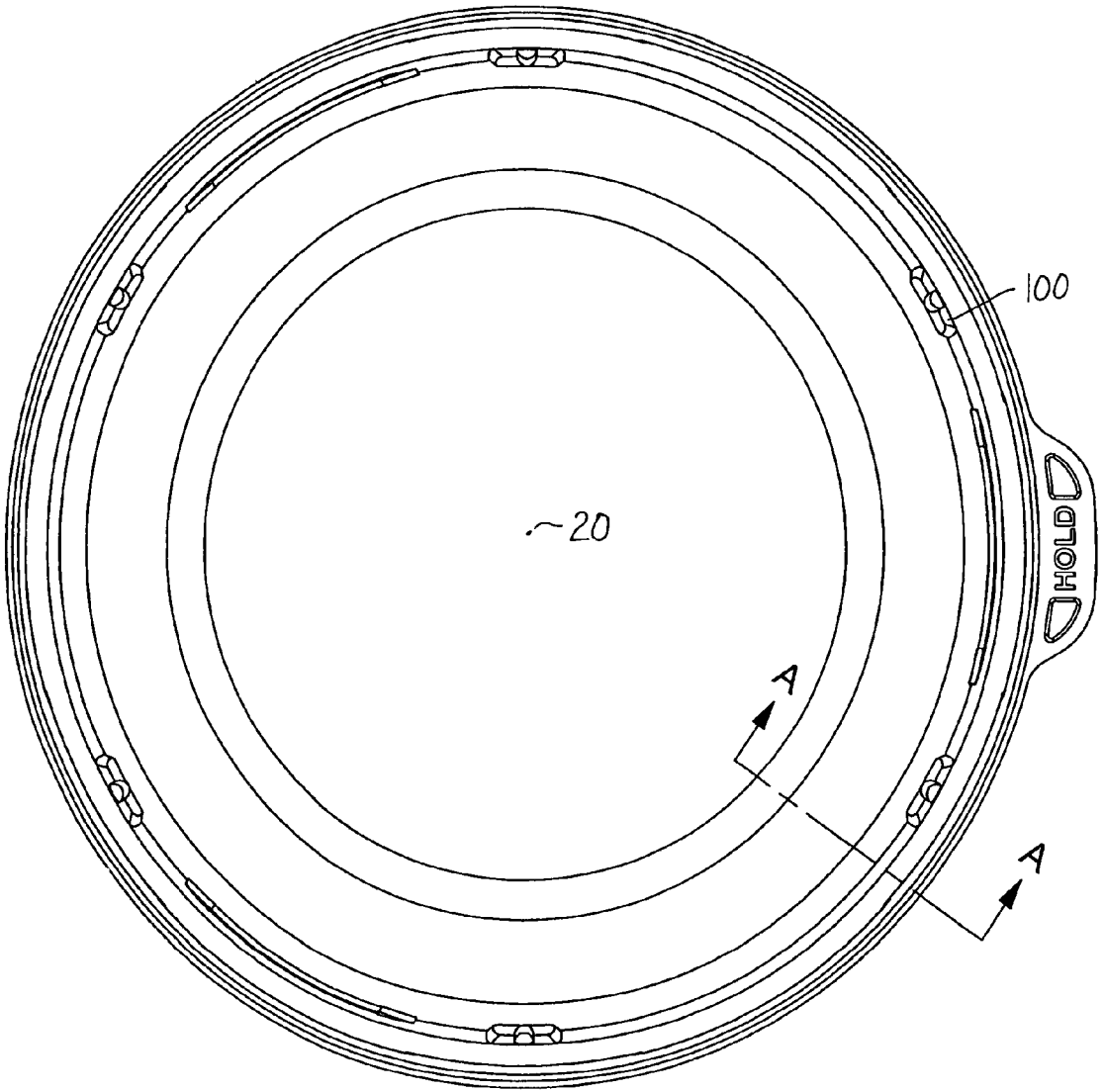
FIG. 6 is a plan view of the closed container of FIG. 2.

The cover has handles 100 (FIG. 5) that are each formed by radial (inward or outward) projections in the primarily vertical cover side wall 40. Each projection forms a pair of shoulders 102, 104 facing at least partially in circumferential directions and extending radially by at least 5 millimeters beyond the cover side wall 40, to enable a person to easily turn the cover. FIG. 6 shows that the particular container has six handles 100 spaced 60° apart. The container has six cover projections and corresponding base recesses spaced 60° apart about the container axis 20. The container should have at least two and preferably at least three uniformly spaced cover projections and corresponding base recesses.

Figure 9:
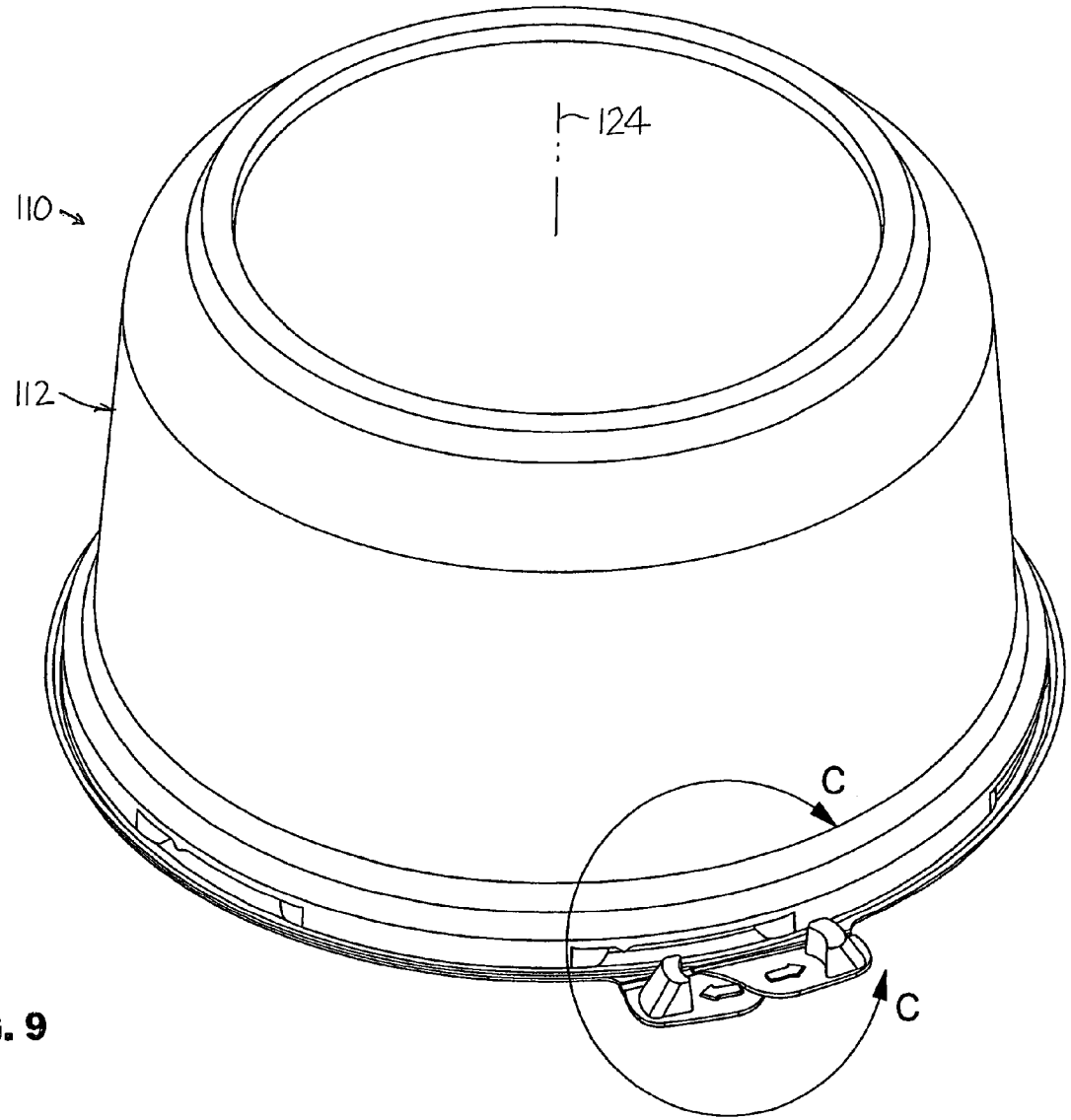
FIG. 9 is a top isometric view of a fully closed container of another embodiment of the invention wherein the cover has a handle in the form of a tab.
Figure 10:
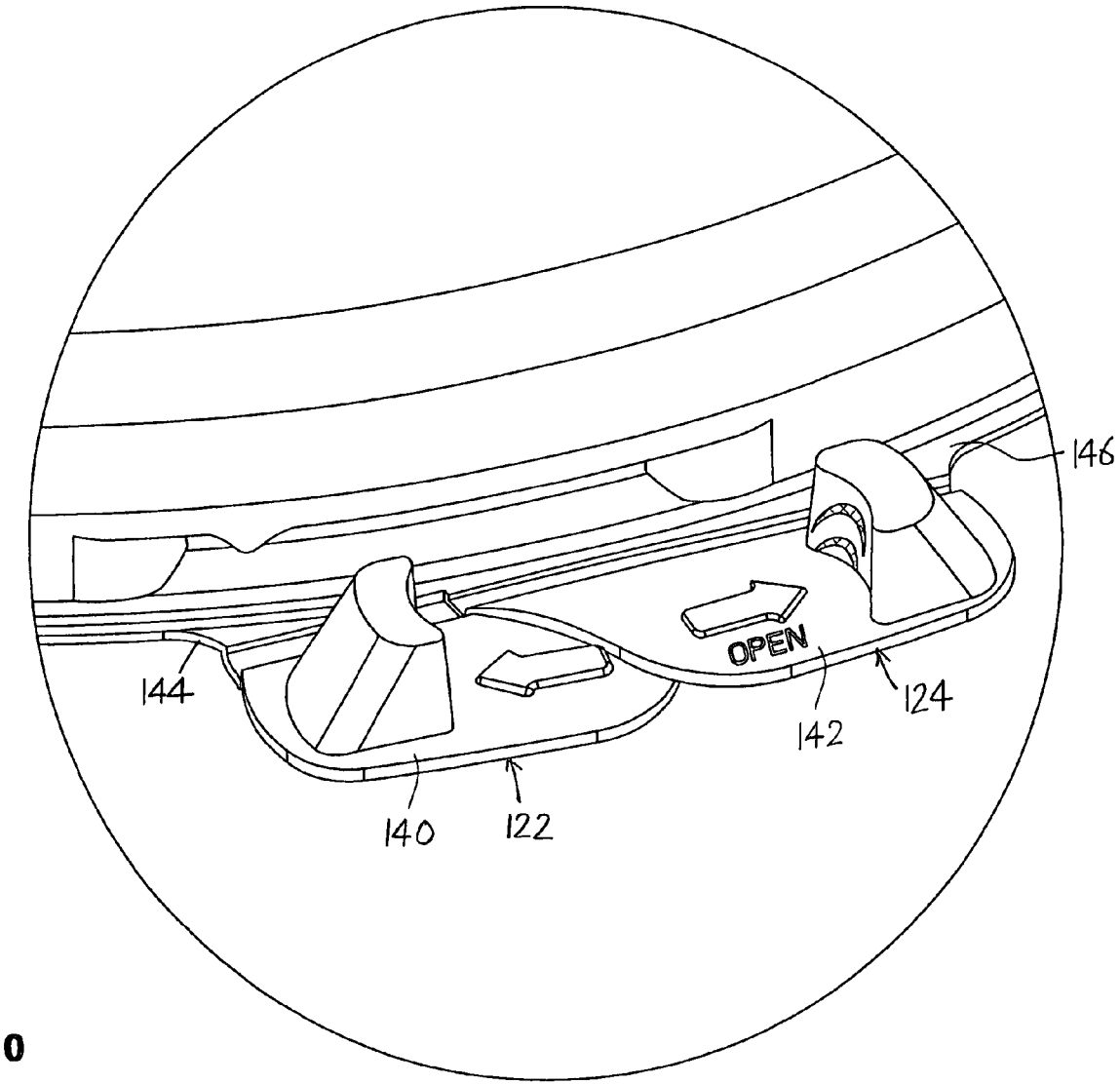
FIG. 10 is an enlarged isometric view of container region C-C of FIG. 9.
Figure 11:
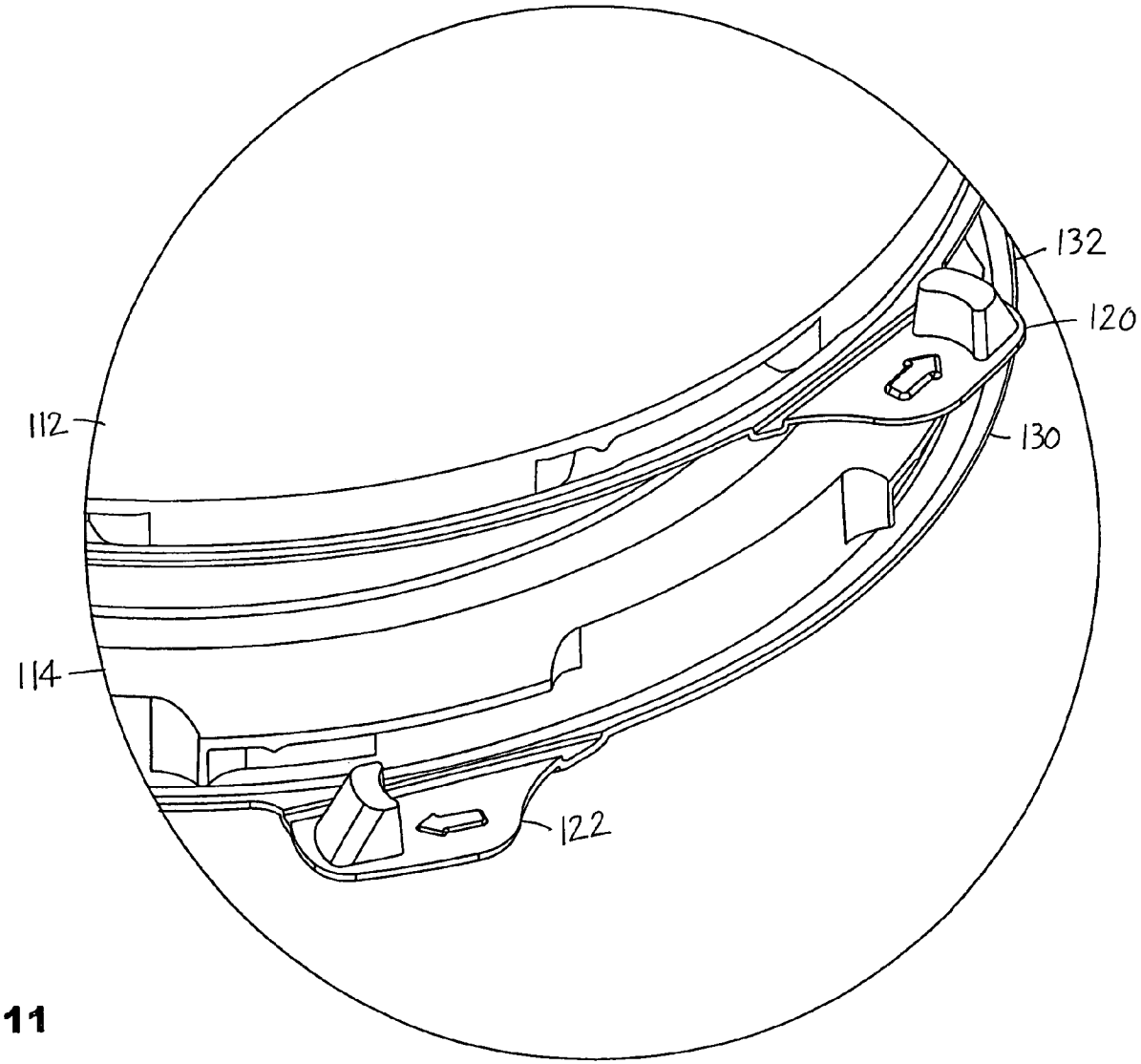
FIG. 11 is an isometric view of the container region of FIG. 10, but with the container having been rotated and the cover lifted to open the container.

FIGS. 9-11 show a container 110 that is similar to that of FIGS. 1-8, except that the cover 112 and base 114 (FIG. 11) each have tab handles 120, 122 that project radially (with respect to the container axis 124) beyond the base and cover outer edges 130, 132. An advantage of this arrangement is that the two handles guide a customer as to the relative positions of the cover and base. A customer learns that the handles should be circumferentially spaced by about 20° as shown in FIG. 11 to lift up or move down the cover with very little force. The handles then are moved close together to the position of FIGS. 9 and 10 to fully close the container.

FIG. 10 shows that the two handles have radially outer portions 140, 142 that are connected to radially inner handle or tab portions 144, 146 that lie at the outer edges of the base and cover. The inner handle portions are easily bendable upward. This assures that if the container is moved down into a cardboard box that has a side wall that abuts the handles, then the handles can pivot up to avoid damage to the handles.

II. FIGS. 12-21

Figure 12:
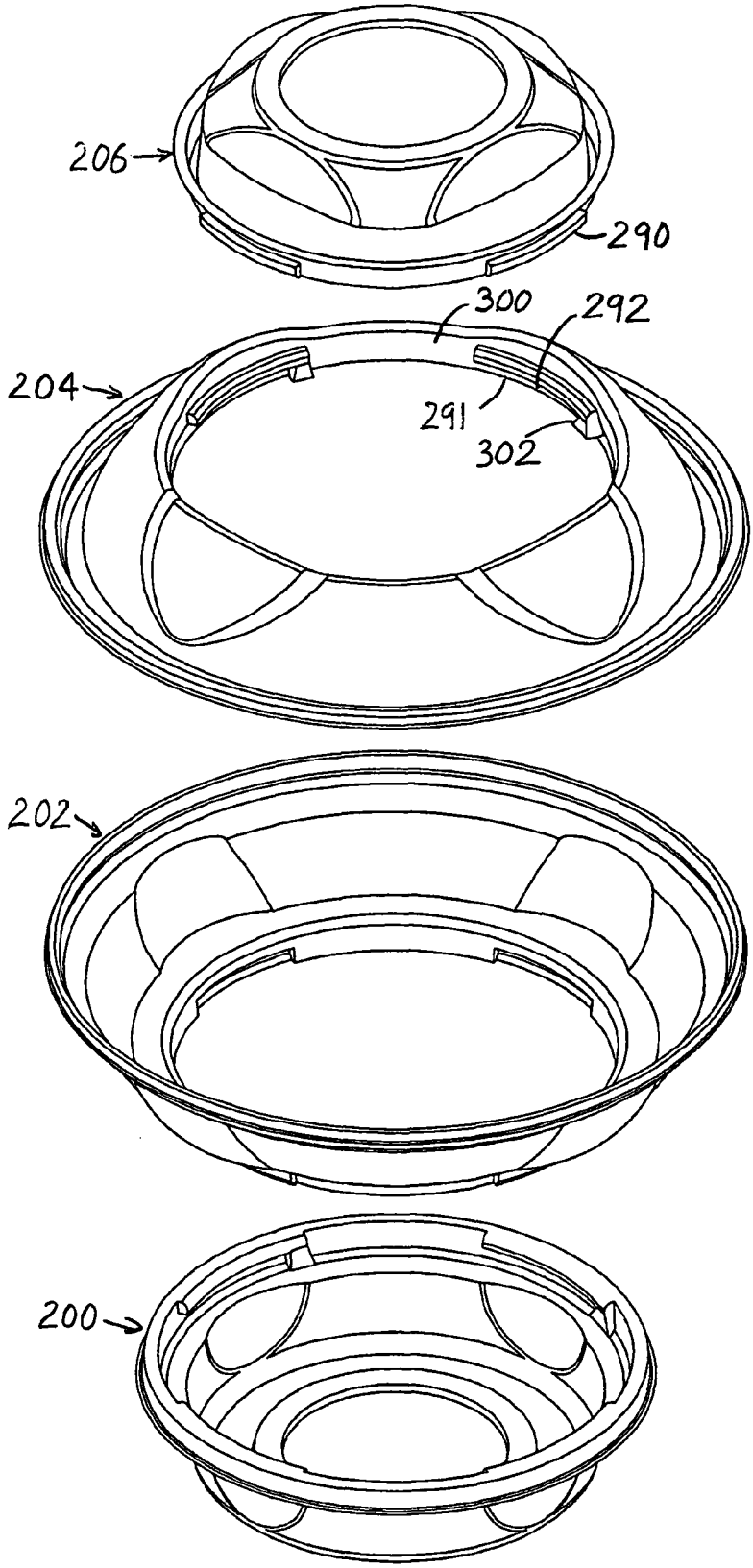
FIG. 12 is an exploded isometric view of a container of another embodiment of the invention which has four container parts.
Figure 13:
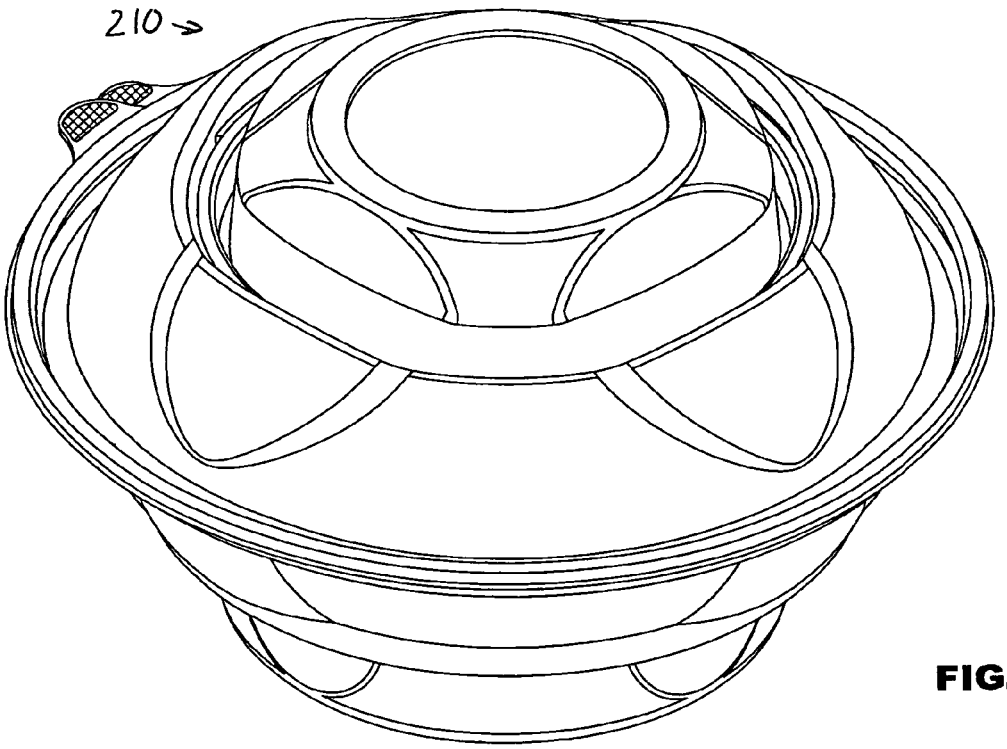
FIG. 13 is an isometric view of the container of FIG. 12.
Figure 14:
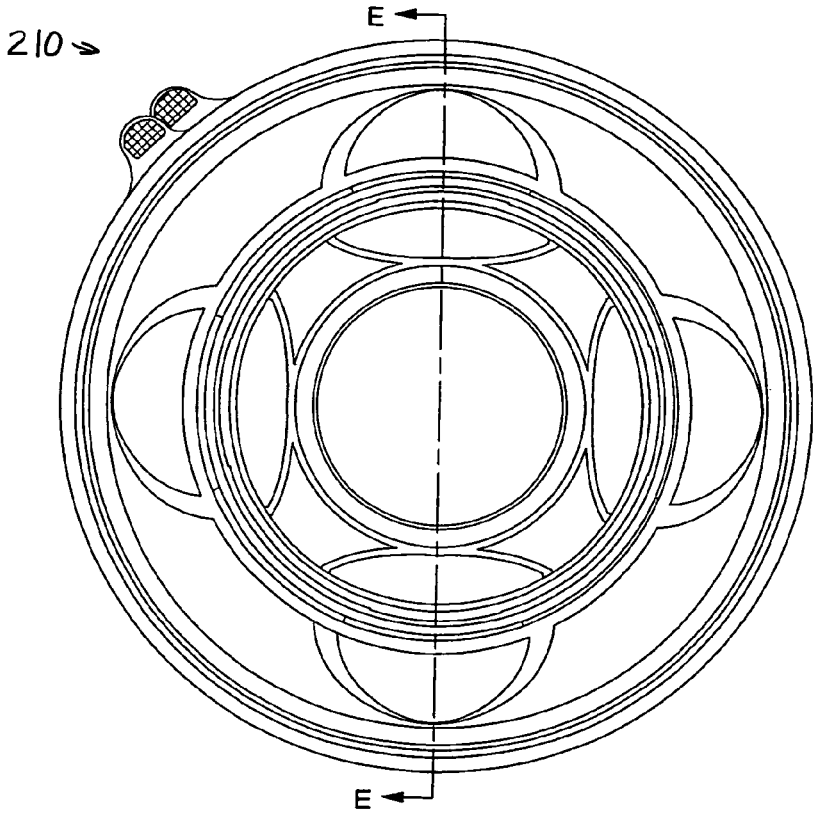
FIG. 14 is a plan view of the container of FIG. 12.
Figure 15:
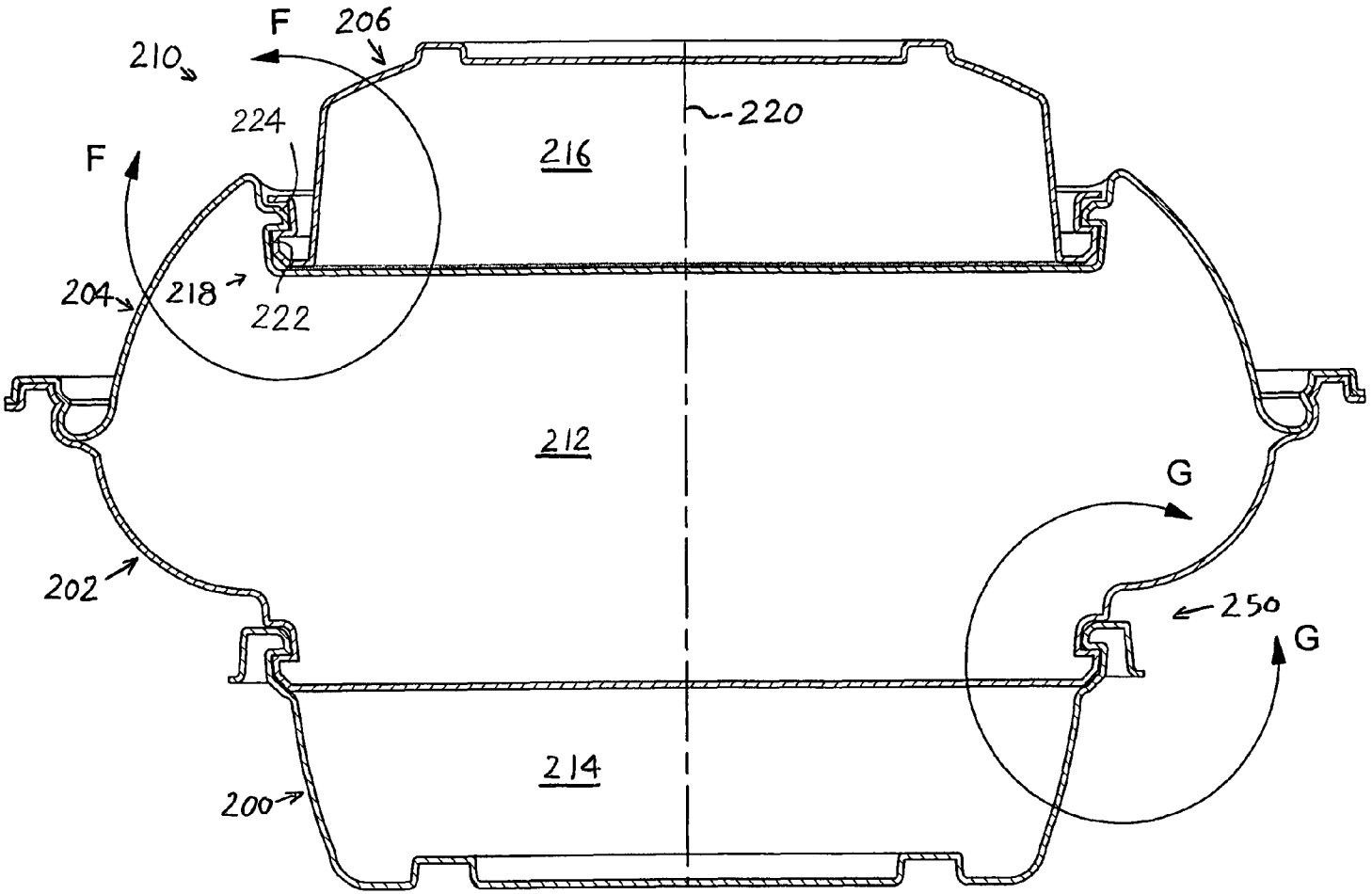
FIG. 15 is a sectional view taken on line E-E of FIG. 14.

FIG. 12 Illustrates container parts 200, 202, 204, 206 that can be assembled into different containers, with FIGS. 13 and 14 illustrate a large container 210 formed out of the four parts. FIG. 15 shows the four container parts assembled into the container 210, with the container having a main cavity 212 and two accessory compartments 214, 216. One example where the container is useful is where the main cavity 212 holds a salad, the upper compartment 216 holds salad dressing, and the lower compartment 214 holds eating utensils. Another example is where the main cavity holds a spaghetti salad, the upper compartment holds deli food (meats, cheese, salad topping and meatballs) and the lower compartment holds utensils.

Figure 20:
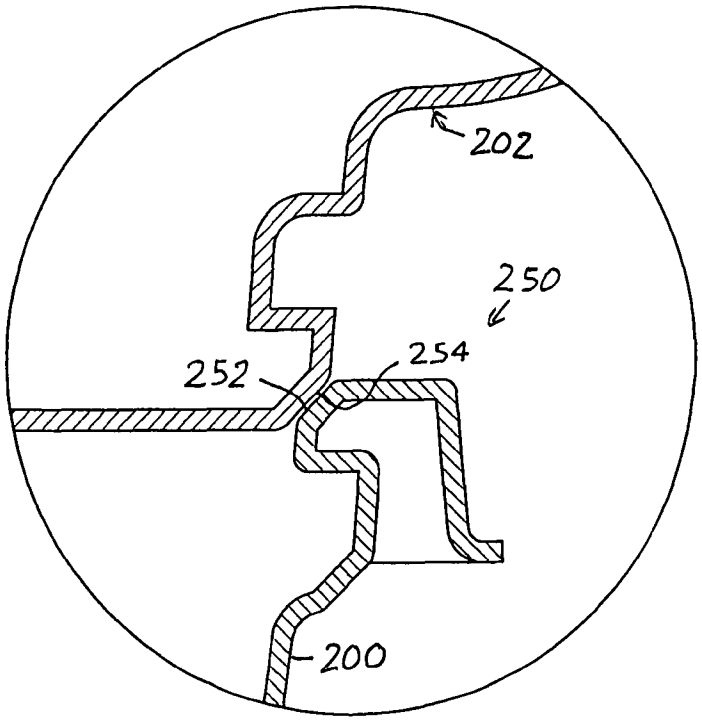
FIG. 20 is an enlarged view of area G-G of FIG. 15.
Figure 19:
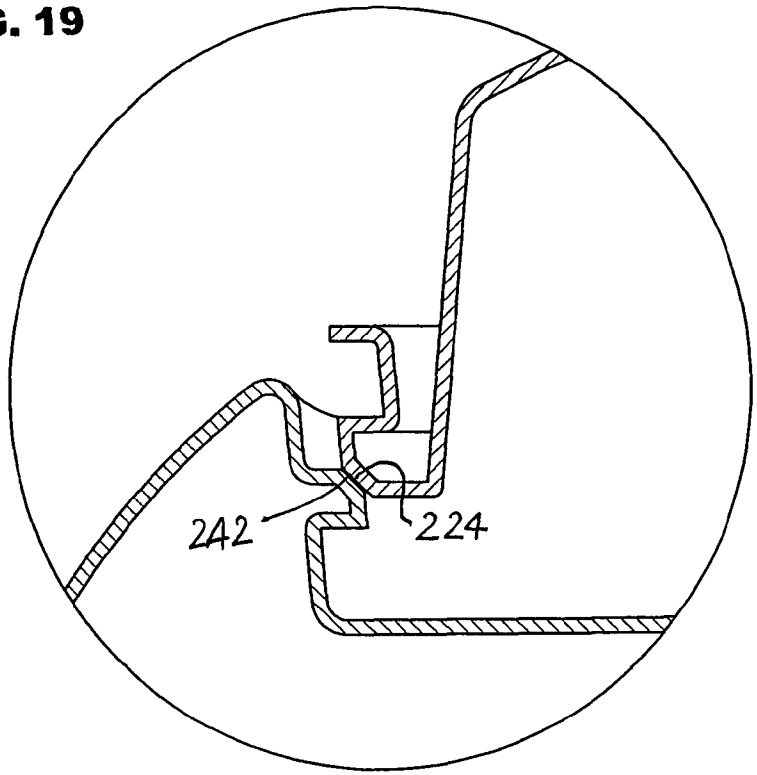
FIG. 19 is an enlarged sectional view of area F-F of FIG. 15.

The upper two container parts 204, 206 of FIG. 15 are joined in a joint 218 wherein one container part 204 forms a radially inward (toward axis 220) groove 222 and forms an inclined wall 224 above the groove. FIG. 19 shows the container parts as they are mated, with inclined surfaces 242, 224 of the two container parts passing across one another before snapping to the final position of FIG. 15A. FIG. 15 also shows a joint 250 where inclined surfaces 252, 254 guide one container part such as 202 as it joins to the other part 200. FIG. 20 shows the inclined guiding surfaces 252, 254 as they begin to deflect across one another as they are mated.

Figure 16:
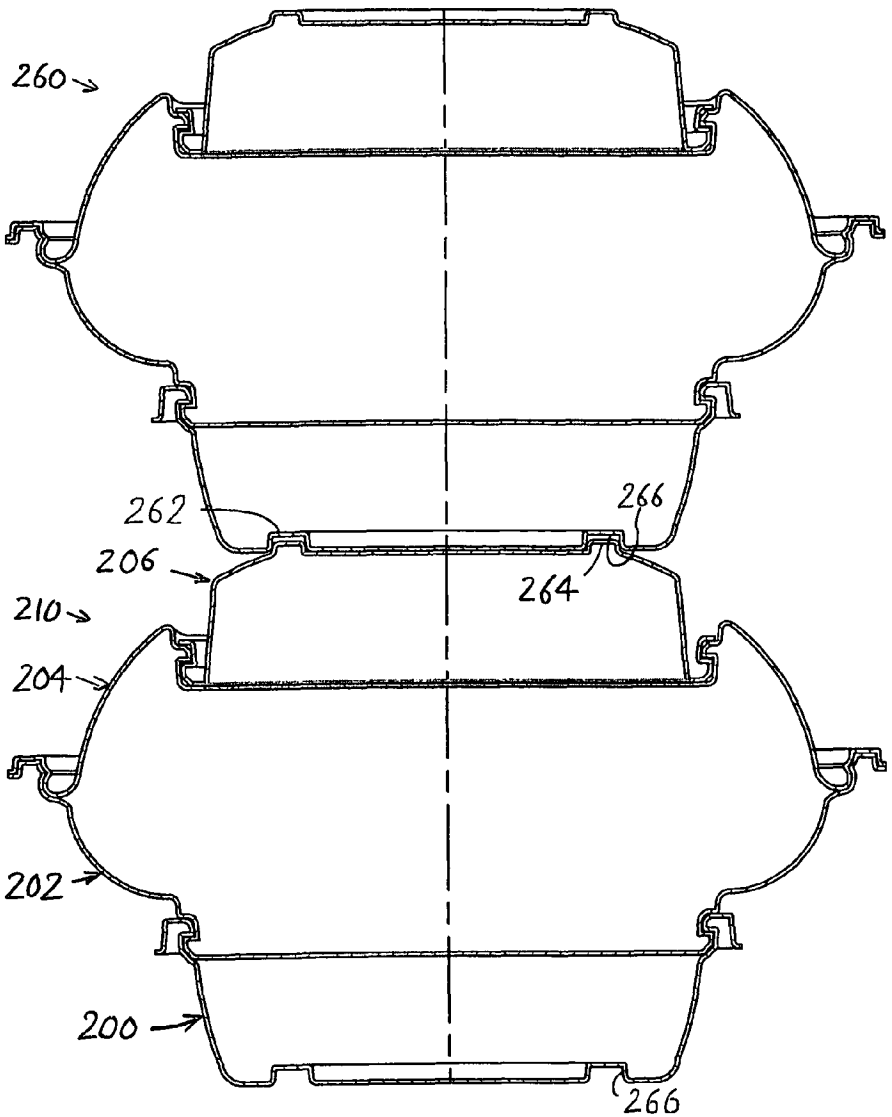
FIG. 16 is a sectional view of two containers of the construction shown in FIG. 15 that are stacked one of the other for easy unstacking.

FIG. 16 shows the container 210 of FIG. 15 and another identical container 260 which are stacked on one another, in a non-latched stacking connection 262, wherein the upper container can be removed by merely lifting it up off the lower container. The upper part 206 of the lower container has an upward projection 264 that extends in a circle, and that projects into a circular groove 266 which can be better seen at the bottom of the lower container part 200.

Figure 17:
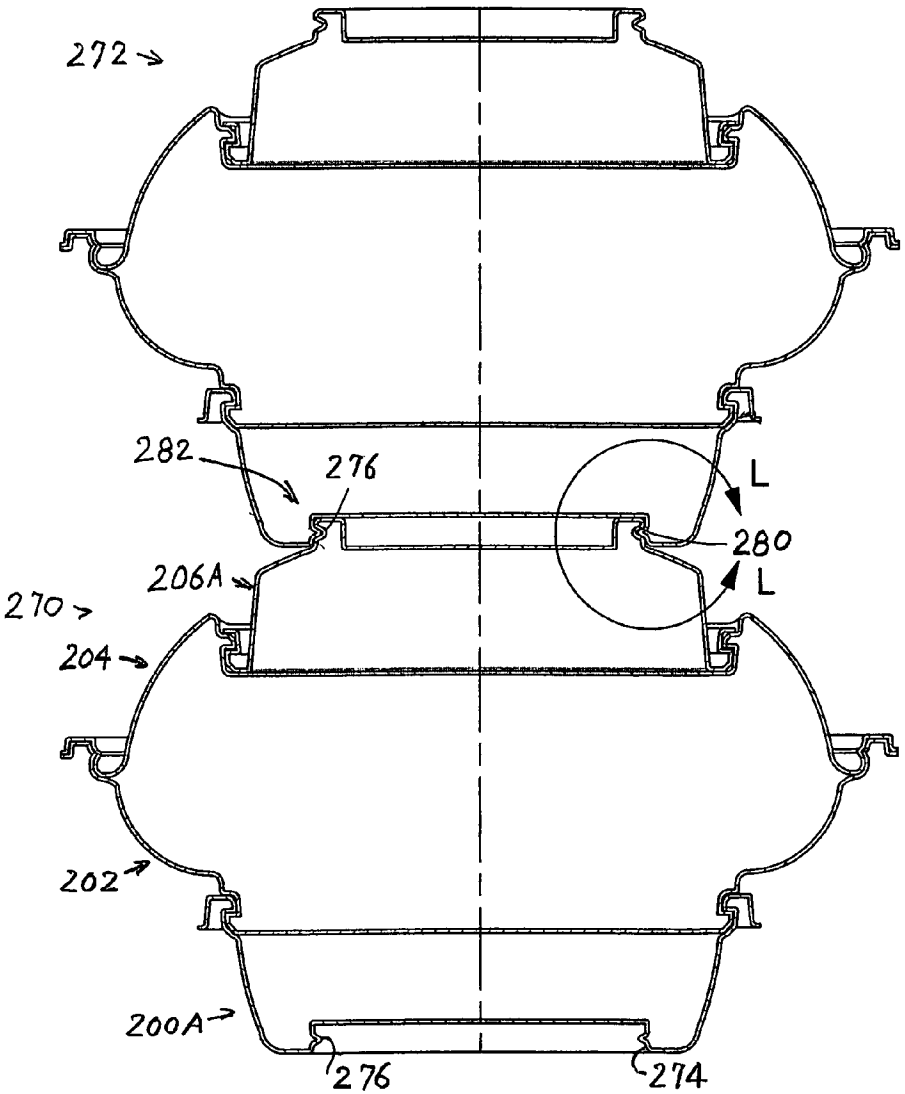
FIG. 17 is a sectional view of a stack similar to FIG. 16 but with some container parts modified for resistance to unstacking.
Figure 18:
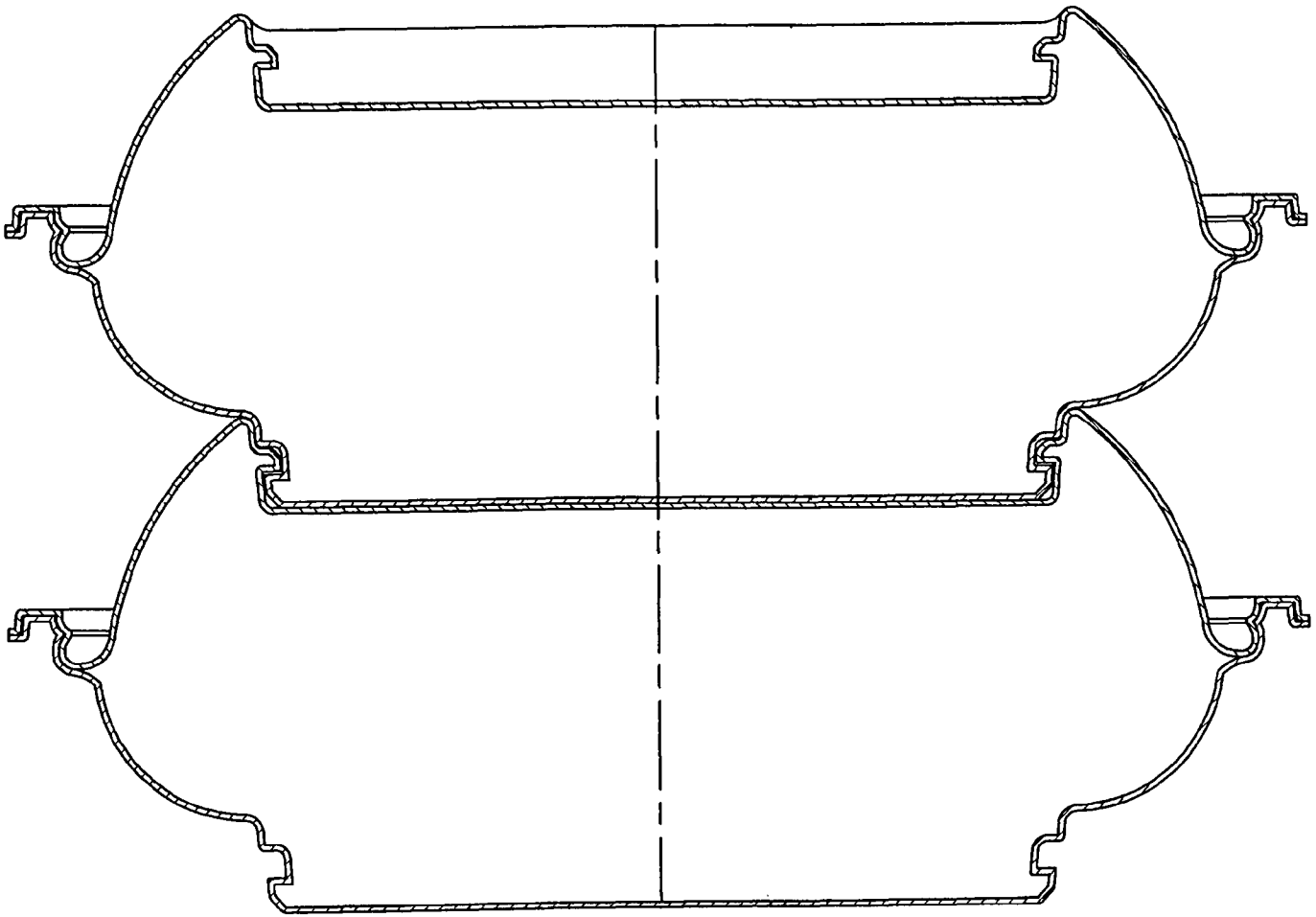
FIG. 18 is a sectional view of two stacked containers each formed from two container parts of FIG. 15.
Figure 21:
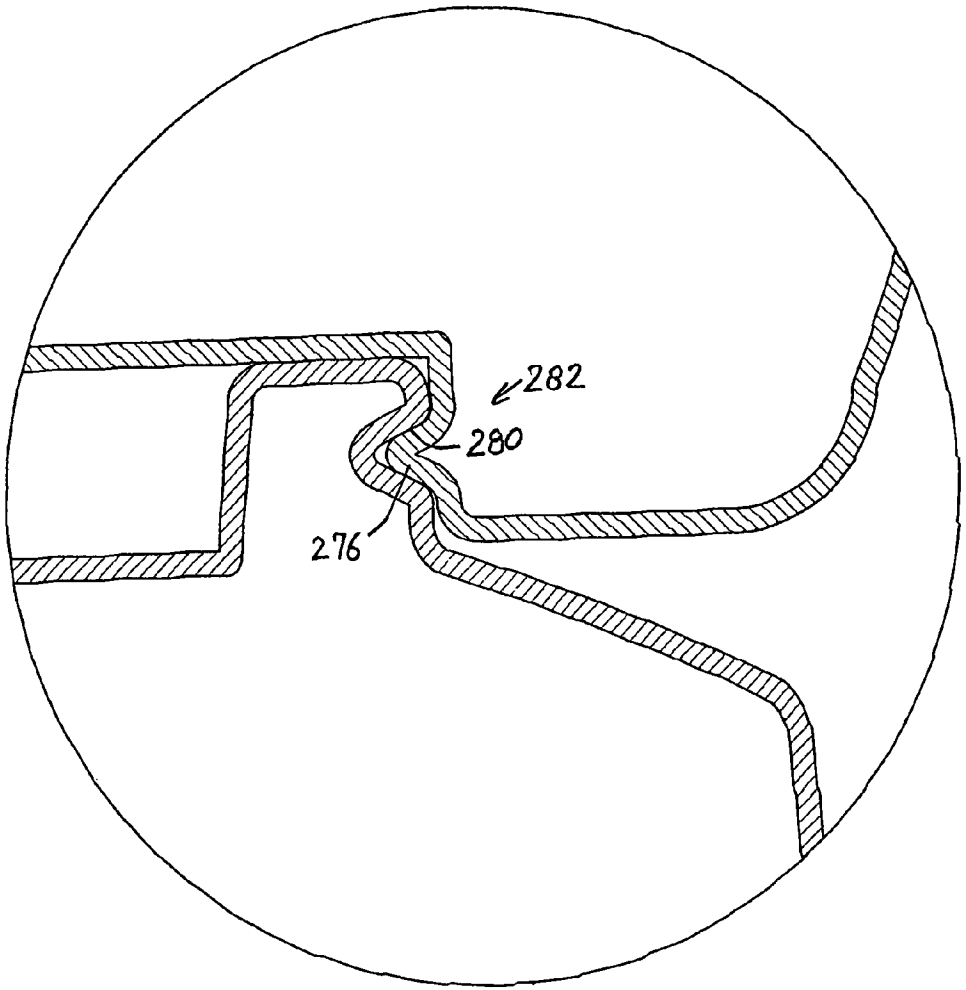
FIG. 21 is an enlarged view of area L-L of FIG. 17.

FIG. 17 shows a pair of identical containers 270, 272 formed from container parts 200A, 202, 204 and 206A, where the container parts 200A and 206A are modified. In FIG. 17, the recess 274 at the bottom of the lower container part 200A has a radially inward projection 276. The upper container part 206A has a radially-outward opening groove 280 that receives the projection 276 of the higher container in a latching connection 282. The connection or joint 282 requires considerable upward force to remove the upper container from the lower one. FIG. 21 shows the joint 282 in detail.

As described above, the container parts can be assembled by merely forcefully pressing down one container part over a lower one until the parts snap together. FIG. 12 shows that the upper container part 206 has four radially outward projections 290 that each fits into a groove 291 under a radially inward flange 292 of the next lower container part 204 when the upper container part 206 has been forced down. To separate the two container parts 206, 204 applicant turns the upper container part 206 until its outward projection 290 lies in a vertically opening recess 300 of the container part 204, and then lifts up the container part 206. As described for FIGS. 1-11, a person can more gently install the upper container part 206 on the next lower one 204 by aligning an outward projection 290 with a recess 300, lowering the upper container part, and turning the upper container part. A stop 302 limits turning. FIG. 13 shows handles 310, 312 on the two container parts, that not only facilitate turning of one container part relative to the other, but that show the relative positions of the two container parts.

The two lowermost container parts 200, 204 of FIG. 12 can be joined in the same manner as the two uppermost container parts 206, 204.

Thus, the invention provides a container comprising a base and cover that are each formed of sheet plastic, which enables a customer to easily close and open the container using low forces, and that enables a worker to very rapidly close the container using a larger force. The base has a vertical passage through which a cover projection can easily pass down or up, and has an undercut groove extending circumferentially therefrom to a stop, with a jut on the cover projection and along the groove to hold the cover closed. The base wall over the groove and stop is beveled, and the bottom of the cover projection is also beveled, to allow cover installation by merely pressing down the cover forcefully, with beveled surfaces then forming a seal. The base has a handle in the form of a tab with a sheet part that extends radially outward under the outer edge of the cover, and with upward projection(s) that form shoulders for preventing turning of the base. The cover can have projections in its side that form shoulders that serve as handles to rotate the cover. The cover and base both can have handle formed from radially-outwardly projecting tabs. The tabs can be provided with hinge portions that enable the tabs to bend up.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A food container comprising a base and cover, said base and cover each having a generally circular periphery centered on a container axis, said base having a periphery portion with a primarily vertical base rim wall, and said cover having a side with a primarily vertical cover rim wall disposed around said base rim wall, wherein:

said cover rim wall has a plurality of radially inward cover projections spaced about said axis;

said cover projections have downward and radially outward beveled cover bottom surface portions, and said base rim wall has a top with downward and radially outward beveled base surface portions, and said cover is installable on said base by pressing down the cover so said cover projection beveled surface portions move radially outward and below said beveled base surface portions;

said base rim wall has a plurality of radially inward base recesses that each has a vertically undercut groove constructed to receive and guide one of said cover projections in circumferential movement, and said base rim wall has a plurality of vertical passages each constructed to upwardly pass a cover projection that has moved along one of said undercut grooves to allow said cover projections to lift off the base rim wall;

said cover is also installable on said base by aligning said cover projections with said vertical passages and allowing said cover projections to move down along the vertical passages, without a barrier to downward movement of the cover projections, and turning the cover so the cover projections slide into said grooves;

said cover has at least one radial projection forming a cover handle to turn the cover, and said base has a portion disposed at least partially in a horizontal plane and projects radially outward under the cover rim wall and beyond the remainder of the base rim wall to form a base handle to prevent the container from turning; and said base handle forms a hinge radially outward of said cover rim wall to allow the base handle to pivot upward.

2. The container described in claim 1 wherein:

said base forms a stop at one circumferential end of each groove disposed opposite the vertical passage, said stop abutting a circumferential end of one of said cover projections when the cover is turned to move its projection away from a corresponding vertical passage.

3. The container described in claim 2 wherein:

said cover projections and walls of said groove, each have juts that engage one another to resist turning the cover to move the cover projection away from the stop, to thereby latch the cover closed.

4. A food container comprising a base and cover, said base and cover each having a generally circular periphery centered on a container axis, said base having a periphery portion with a primarily vertical base rim wall, and said cover having a side with a primarily vertical cover rim wall disposed around said base rim wall, wherein:

said cover rim wall has a plurality of radially inward cover projections spaced about said axis;

said cover projections have downward and radially outward beveled cover bottom surface portions, and said base rim wall has a top with downward and radially outward beveled base surface portions, and said cover is installable on said base by pressing down the cover so said cover projection beveled surface portions move radially outward and below said beveled base surface portions;

said base rim wall has a plurality of radially inward base recesses that each has a vertically undercut groove constructed to receive and guide one of said cover projections in circumferential movement, and said base rim wall has a plurality of vertical passages each constructed to upwardly pass a cover projection that has moved along one of said undercut grooves to allow said cover projections to lift off the base rim wall;

said cover is also installable on said base by aligning said cover projections with said vertical passages and allowing said cover projections to move down along the vertical passages, without a barrier to downward movement of the cover projections, and turning the cover so the cover projections slide into said grooves; and said cover and base each has at least one radial projection forming a handle to facilitate turning one element with respect to the other, the cover having a plurality of said radial projections;

wherein said radial projections in said cover are formed in said cover by localized radial projections that each has shoulders of a radial depth of at least 5 millimeters.

5. The container described in claim 4 wherein:

said base forms a stop at one circumferential end of each groove disposed opposite the vertical passage, said stop abutting a circumferential end of one of said cover projections when the cover is turned to move the cover projection away from a corresponding vertical passage.

6. The container described in claim 5 wherein:

said cover projections and walls of said groove, each have juts to engage one another and resist turning the cover to move the cover projection away from the stop, to thereby latch the cover closed.

7. A food container comprising a base and cover, said base and cover each having a generally circular periphery centered on a container axis said base having a periphery portion with a primarily vertical base rim wall, and said cover having a side with a primarily vertical cover rim wall disposed around said base rim wall, wherein:

said cover rim wall has a plurality of radially inward cover projections spaced about said axis;

said cover projections have downward and radially outward beveled cover bottom surface portions, and said base rim wall has a top with downward and radially outward beveled base surface portions, and said cover is installable on said base by pressing down the cover so said cover projection beveled surface portions move radially outward and below said beveled base surface portions;

said base rim wall has a plurality of radially inward base recesses that each has a vertically undercut groove constructed to receive and guide one of said cover projections in circumferential movement, and said base rim wall has a plurality of vertical passages each constructed to upwardly pass a cover projection that has moved along one of said undercut grooves to allow said cover projections to lift off the base rim wall;

said cover is also installable on said base by aligning said cover projections with said vertical passages and allowing said cover projections to move down along the vertical passages, without a barrier to downward movement of the cover protections, and turning the cover so the cover projections slide into said groove;

said cover has cover seal surface portions disposed above a height of said beveled cover bottom surface portion, said cover seal surface portion being beveled at an angle matching said beveled base surface portions disposed facewise against and sealed to said beveled base surface portions.

8. The container described in claim 7 wherein:

said base forms a stop at one circumferential end of each groove disposed opposite the vertical passage, said stop abutting a circumferential end of one of said cover projections when the cover is turned to move its projection away from a corresponding vertical passage.

9. The container described in claim 8 wherein:

said cover projections and walls of said groove, each have juts to engage one another and resist turning the cover to move the cover projection away from the stop, to thereby latch the cover closed.

10. A food container comprising a base and cover, said base and cover each centered on a vertical axis and each having a generally circular periphery, said base having a peripheral portion with a primarily vertical base rim wall and with a bottom of the base that can be disposed on a horizontal surface, and said cover having a primarily vertical cover rim wall disposed around said base rim wall, wherein:

said base and cover each have handles to turn one relative to the other, with said base handle disposed no more than 5 mm above said bottom of said base; and said base handle has a portion that extends under said cover rim and radially outward from said cover rim by a distance of at least one centimeter and that forms upward vertically-projecting circumferentially-facing shoulders facing in circumferentially opposite directions for preventing the base from turning when the cover is turned while said base rests on a horizontal surface.

11. The container described in claim 10 wherein:

said cover rim wall has a generally smooth primarily vertical side wall portion with a plurality of circumferentially-elongated radially inwardly-projecting cover projections that are uniformly spaced about said axis;

said base has a plurality of vertical passages that each receives one of said cover projections by downward movement of the cover projection into the vertical passage, said base also having a plurality of circumferentially-extending grooves with far ends that each forms a stop, each cover projection being moveable from the bottom of a vertical passage circumferentially into and along a groove by turning of the cover; and each cover projection has a beveled bottom surface, and said base rim wall has an upper surface above said grooves and above said stops which is also beveled, to enable the cover projections to be forced down around the base rim wall to mount the cover on the base, the grooves and vertical passages allowing separation of the cover from the base.

12. The container described in claim 10 wherein:

said base handle forms a hinge within 0.5 centimeter of the radially outward end of said cover rim, said hinge allowing said tab to pivot up toward the vertical.

* * * * *